US010647336B2

(12) United States Patent
Consoli

(10) Patent No.: US 10,647,336 B2
(45) Date of Patent: May 12, 2020

(54) METHOD AND DEVICES FOR CHECKING THE CORRECT RAIL POSITION OF A GUIDED VEHICLE

(71) Applicant: SIEMENS MOBILITY SAS, Chatillon (FR)

(72) Inventor: Luciano Consoli, Paris (FR)

(73) Assignee: Siemens Mobility SAS, Chatillon (FR)

( * ) Notice: Subject to any disclaimer, the term of this patent is extended or adjusted under 35 U.S.C. 154(b) by 390 days.

(21) Appl. No.: 14/908,643

(22) PCT Filed: Jun. 26, 2014

(86) PCT No.: PCT/EP2014/063498
§ 371 (c)(1),
(2) Date: Jan. 29, 2016

(87) PCT Pub. No.: WO2015/014548
PCT Pub. Date: Feb. 5, 2015

(65) Prior Publication Data

US 2016/0167685 A1 Jun. 16, 2016

(30) Foreign Application Priority Data

Jul. 29, 2013 (EP) ..... 13290178

(51) Int. Cl.
*B61L 1/04* (2006.01)
*B61F 9/00* (2006.01)
(Continued)

(52) U.S. Cl.
CPC ..... *B61L 1/04* (2013.01); *B61F 9/00* (2013.01); *B61F 9/005* (2013.01); *B61L 15/00* (2013.01);
(Continued)

(58) Field of Classification Search
CPC ..... B61L 23/00; B61L 25/00; B61L 13/00; B61L 13/002; B61L 13/04; B61L 13/042;
(Continued)

(56) References Cited

U.S. PATENT DOCUMENTS 100,442 A * 3/1870 Platt ..... B61L 1/04 246/246
182,384 A * 9/1876 Putnam ..... B61L 3/10 246/195
(Continued)

FOREIGN PATENT DOCUMENTS

CN 2721474 Y 8/2005
CN 102470877 A 5/2012
(Continued)

*Primary Examiner* — Zachary L Kuhfuss

(74) *Attorney, Agent, or Firm* — Laurence Greenberg; Werner Stemer; Ralph Locher

(57) ABSTRACT

A method and a system for checking the correct rail position of a guide member of a guided vehicle. The system is based on the use of an electrical switch designed to cooperate with a guide member of the vehicle guided by at least one guide rail. The switch has two states, respectively a first state and a second state. In one of the states the electrical switch is open and in the other state the electrical switch is closed. The switch is mounted on a load-bearing structure such that it is able to interact with the guide member. The switch is able to switch from the first state to the second state by interacting with at least one part of the guide member.

15 Claims, 9 Drawing Sheets

(51) Int. Cl.

| | |
|---|---|
| ***H01H 15/06*** | (2006.01) |
| ***B61L 15/00*** | (2006.01) |
| ***B61L 23/00*** | (2006.01) |
| ***H01H 21/02*** | (2006.01) |

(52) U.S. Cl.
CPC ..... *B61L 23/00* (2013.01); *H01H 15/06* (2013.01); *H01H 21/02* (2013.01)

(58) Field of Classification Search
CPC ..... B61L 13/045; B61L 1/04; B61L 13/02; B61F 9/005; B62D 1/265
See application file for complete search history.

(56) References Cited

U.S. PATENT DOCUMENTS 283,152 A * 8/1883 Scott ..... B61L 1/04 246/250
327,576 A * 10/1885 Myers ..... B61L 1/04 246/246
1,385,295 A * 7/1921 Abric ..... B61L 13/04 246/74
1,515,587 A * 11/1924 Arcani ..... B61L 11/083 246/226
1,647,954 A * 11/1927 Bruna ..... B61L 3/185 246/182 R
1,798,256 A * 3/1931 Grondahl ..... B61L 13/047 246/63 A
2,892,078 A * 6/1959 Orthuber ..... B61L 1/10 246/249
3,383,504 A * 5/1968 Dennison ..... B61L 13/047 246/249
4,038,928 A * 8/1977 Degen ..... B61F 5/245 104/242
4,090,452 A * 5/1978 Segar ..... B60M 1/30 104/130.01
4,168,770 A * 9/1979 Segar ..... B60L 5/36 191/32
4,200,855 A * 4/1980 Gilcher ..... B61K 9/12 246/249
4,204,478 A * 5/1980 Schmitz ..... G01L 17/005 104/247
4,283,031 A * 8/1981 Finch ..... B61L 1/10 246/128
4,387,870 A 6/1983 Matty et al.
5,628,479 A * 5/1997 Ballinger ..... B61L 1/165 246/122 R
6,029,579 A 2/2000 Andre et al.
6,363,860 B1 4/2002 Andre
6,371,417 B1 * 4/2002 Southon ..... B61L 1/165 246/247
6,663,053 B1 * 12/2003 Shams ..... B61L 5/107 246/122 R
7,228,803 B2 6/2007 Andre et al.
7,481,400 B2 * 1/2009 Appleby ..... B61L 1/06 246/122 R
8,141,496 B2 3/2012 Andre
8,146,512 B2 4/2012 Andre et al.
8,511,622 B2 8/2013 Consoli
8,599,017 B2 12/2013 Clarissou
2004/0225421 A1 * 11/2004 Wu ..... B61L 27/04 701/19
2006/0261218 A1 * 11/2006 Mace ..... B61F 5/386 246/169 R
2010/0065692 A1 3/2010 Andre
2012/0006946 A1 * 1/2012 Clarissou ..... B61K 9/12 246/120

FOREIGN PATENT DOCUMENTS

| | | | | |
|---|---|---|---|---|
| EP | 1614602 | A1 | 1/2006 | |
| EP | 2641806 | A1 * | 9/2013 | ..... B61F 9/00 |
| FR | 2909061 | A1 | 5/2008 | |
| JP | H0520963 | A | 1/1993 | |
| JP | 2012006568 | A | 1/2012 | |
| RU | 2463184 | C2 | 10/2012 | |
| WO | 2008074942 | A1 | 6/2008 | |
| WO | 2010102676 | A1 | 9/2010 | |
| WO | 2011012176 | A1 | 2/2011 | |

* cited by examiner

METHOD AND DEVICES FOR CHECKING THE CORRECT RAIL POSITION OF A GUIDED VEHICLE

BACKGROUND OF THE INVENTION

Field of the Invention

The present invention relates to a method and a system for checking the correct rail position of a guided vehicle, as well as a dedicated electrical switch for this function.

Specifically, the invention relates to the detection and monitoring of the correct or incorrect rail position of a guide member of a guided vehicle.

"Guided vehicle" refers to public transport means such as buses, trolleybuses, streetcars, subways, trains or train units, etc., as well as load transporting means such as, for example, overhead traveling cranes, for which safety is a very important factor and which are guided specifically by a single rail. This latter is used to guide a guide member of the guided vehicle, said guide member usually bearing against the rail and following the path thereof when the guided vehicle is moving. The guide member enables, for example, a guidance system to direct a steering axle of the guided vehicle along the path defined by the rail, said axle being, for example, provided with load-bearing wheels.

A first known variant of the guide member includes a pair of guide wheels, also called guide rollers, each provided with a rim and arranged in a V shape, i.e. the running planes of said wheels are inclined in relation to one another such as to form a V shape, the axis of rotation of one of said wheels forming a salient angle with the axis of rotation of the other of said wheels in order to clamp the guide rail in the jaw formed by said rollers fitted with the respective rims thereof. Such a guide member is for example described in documents U.S. Pat. Nos. 7,228,803 B2, 6,029,579 A1, 6,363,860 B1, and WO 2008/074942 A1. Such a guide member ensures the safe guidance of the vehicle until it has stopped. It can for example prevent material damage caused by a loss of guidance and ensure the physical safety of staff or passengers on board in the case of public transport.

The operating principle of guided vehicles including this type of guide member is explained using FIGS. 1 to 3. FIG. 1 shows a pair of rollers 1, 2 arranged in a V shape of a guide member known to the person skilled in the art. The pair of rollers 1, 2 clamps a rail 3 with which it is in contact and thus forces the guide member to follow a path defined by the rail 3, said path being consequently followed by the steering axle of the guided vehicle that is cooperating with said guide member. The guide rail 3 comprises in particular a base plate 4 attached to the ground 5 and a web 6 supporting a railhead 7 against which the rollers 1, 2 bear via a tire 9. The tire 9 of each of the rollers 1, 2 in a single pair of guide rollers is therefore in contact with a surface of the railhead 7, known as the rail surface 8 and distributed symmetrically on either side of the upper part of the railhead 7. Each of the rollers also includes a rim 10 extending, in nominal position, beneath the railhead 7 of said rail 3, enabling said railhead 7 to be freely clamped. As the vehicle moves, the rollers 1, 2 are in contact with the railhead 7, and the respective rims 10 thereof surround this latter, contactlessly in nominal mode, and approach the web 6 beneath it. As the distance between the lower extremities 201, 101 of the two rims 10 surrounding the railhead 7 is less than the width C of the railhead 7, the removal of the railhead 7 from the grip of said rollers 1, 2, or from the zone between the tires 9 and the rims 10, is only possible if the roller attachment angle 11, i.e. the angle corresponding to the sector formed by the axes of rotation of each of the rollers 1, 2 in a pair of rollers which is intersected by the plane of symmetry of the pair of rollers arranged in a V shape, is increased and/or if the rims 10 and/or the outer edges of the railhead 7 are deformed.

The correct orientation of the vehicle is therefore obtained by coupling the pair of rollers in the guide member with the steering axle of the vehicle. If the rollers are correctly fitted around the guide rail, the vehicle follows the path described by the rail when moving. Conversely, if the rollers are not in their normal or nominal operating position, for example if the railhead of the guide rail moves outside the zone between the tires and the rims, the vehicle risks leaving the path initially established by the rail (see FIG. 2). Indeed, once the rollers are no longer bound to follow the direction imposed by the guide rail, they can move to the right or left of the rail, thereby deviating the vehicle from the intended path. This scenario is described as a loss of vehicle guidance. In other words, the correct position of the rollers is a necessary condition to ensure the vehicle is steered correctly.

A second variant of the guide member is described in document WO 2008/074942 A1, comprising a pair of rollers closely fitting a railhead, as described above, with the difference that the rollers do not have rims. In this case, the wheel rims are replaced by rims rigidly connected to an attachment base of the rollers, these latter also being protected by a safety shield. This arrangement provides greater rigidity, which increases the force required to separate the rollers from the rail.

Regardless of the variant of the guide member considered, it is possible for the railhead to move outside the grip of the rollers. This is for example the case when a vertical upwards pulling force is applied to the rollers or to an attachment base of the rollers such that a deformation of the parts (rim and/or railhead and/or axis of the rollers) causes the distance between the rims to exceed the width of the railhead. In this case, the rollers no longer grip the rail and can be positioned beside the rail, as shown in FIG. 2, the reference characters used in FIG. 1 also being used for FIG. 2.

Furthermore, in workshops, it is common to lift vehicles to perform maintenance work. For this purpose, at least one zone of said workshop, referred to as the lifting zone, is fitted with a guide rail 3 with no railhead (see the web 61 of said rail 3 in FIG. 3) that is used for lifting said vehicles. This rail is characterized in that the width C of the upper part thereof is less than the distance between the extremities of the two rims 101, 201 of the rollers of the guide member. Thus, the guide member can be released from the rail clamping force resulting from the geometry of the railhead and of the rollers, and it is then possible to lift the vehicle vertically in order to perform maintenance work without the rail being caught between the guide rollers. On completion of the maintenance work, the vehicle is returned to the running track thereof and the rollers return to the position shown in FIG. 3. At the exit of the lifting zone, the guide rail regains said railhead 7 after a transition zone.

In said transition zone, it is necessary to check the correct rail position of the guide members of the guided vehicle. Indeed, when dropping the guided vehicle back onto the related running track and moving it into the transition zone, it should be monitored to guarantee the correct rail position of the rollers of each of the guide members of the guided vehicle. If the rail head of the rail is not correctly engaged between the pair of guide rollers, said guide member is no longer able to guide the vehicle, with serious consequences for the hardware, staff and passengers.

Consequently, checking the correct rail position of the guide rollers of a guided vehicle is an important stage to guarantee the operational safety of said guided vehicle. This check is always carried out manually, even for automatic vehicles. Although existing devices and methods already make it possible to detect both a change from an on-rail state to a derailed state of a guided vehicle (for example WO 2011/012176), and the presence of the rail (for example WO 2010/102676 or US 2010/0065692), these devices and methods are based on on-board hardware that has to be installed on each pair of guide rollers, which exponentially increases untimely faults and increases installation and maintenance costs.

BRIEF SUMMARY OF THE INVENTION

One objective of the present invention is to propose a simple, safe and reliable automatic system for checking the correct rail position of the rollers on a guide rail, in particular in a workshop, regardless of the presence or absence of a railhead on said rail.

To achieve this objective, an electrical switch, a monitoring system and a method are claimed.

A set of sub-claims also sets out the advantages of the invention.

The present invention relates in particular to an electrical switch intended to cooperate with a guide member of a vehicle guided by at least one guide rail, said switch including for example a first contact and a second contact, said switch being characterized by two states, respectively a first or initial state and a second or transitory state, said switch being open in one of the states—i.e. it is configured to prevent the flow of an electrical current in an electrical circuit, for example said contacts of said switch are isolated electrically from one another and are able to form an open electrical circuit—and in the other state, said switch being closed—i.e. it is configured to re-establish the flow of said electrical current in said electrical circuit, for example said contacts are connected electrically to one another and are able to form a closed electrical circuit, —said switch being characterized in that it is assembled on/attached to a load-bearing structure that is in particular rigidly connected to the ground, such that it can interact with said guide member when said guide member approaches said load-bearing structure, said switch being switchable from said first state to said second state by interaction with at least one part of said guide member, said switch being able to return automatically to said first state once said interaction has ceased, for example when it is interrupted or terminated. Thus, once said interruption has ceased, said switch automatically returns to the initial state thereof, i.e. said first state.

According to a preferred embodiment, said electrical switch is able to interact contactlessly with said part of the guide member. For this purpose, said electrical switch includes in particular at least one contactless sensor able to detect the presence of said part of said guide member without touching said guide member. Such a sensor is for example an optical, inductive, capacitive or ultrasonic sensor, said interaction being respectively an optical interaction (for example a beam cut by the passage of said part of said guide member and re-established in the absence of the guide member in the vicinity of said load-bearing structure), a magnetic interaction (for example a modification of the magnetic field emitted by said sensor in the presence of said part of said guide member), an electrical interaction (for example a modification of the electrical field in the vicinity of said sensor in the presence of said part of the guide member), or an acoustic interaction (for example a modification of a wave emitted by said sensor and induced by the presence of said part of the guide member).

According to another preferred embodiment, said electrical switch is able to interact mechanically with said part of the guide member. Said switch is for example a lever switch positioned using said load-bearing structure such that said lever of the electrical switch is able to interact mechanically with a part of the guide member, for example a rim or a roller. Specifically, said electrical switch includes said first contact and said second contact, said contacts being mounted on/attached to said load-bearing structure such as to enable said mechanical interaction of at least one of said contacts with said guide member, said load-bearing structure being preferably said guide rail, and said contacts being in particular arranged longitudinally beside one another or on top of one another, for example on said guide rail or on at least one of the sides thereof, or on each of the sides thereof, or even beneath the railhead of said guide rail, said contacts also being electrically isolated from said guide rail. Specifically, said switch is able to switch from said first state to said second state by mechanical interaction with at least said part of said guide member, said mechanical interaction being preferably able to cause either the switch to close by connecting said first contact to said second contact (electrical circuit closed, enabling an electrical current to flow through said circuit) or said switch to open by disconnecting said first contact from said second contact (electrical circuit open, preventing electrical current from continuing to flow through said circuit).

Said load-bearing structure is in particular arranged such as to bear said electrical switch, and in particular the sensor thereof or said contacts, to enable said electrical switch to interact contactlessly or mechanically with said part of the guide member when this latter is in the vicinity of said load-bearing structure. Said load-bearing structure may for example be the ground, or simply the rail, or a mechanical supporting element intended to be attached to the ground in the vicinity of said rail, having for example at least one movable part that enables said switch to be positioned. Said sensor is in particular positioned to ensure that said interaction only occurs if said guide member is correctly positioned on said rail. By way of example, FIG. 12 illustrates different positions of the electrical switch according to the invention in the vicinity of said guide member.

According to the present invention, said change of state of the switch is caused in particular by a mechanical interaction between said part of said guide member and said switch. Examples of mechanical interaction include:

- mechanical friction of said part of the guide member on said contacts of the switch, said friction being able to create an at least temporary electrical connection between said first and second contacts, the absence of said mechanical friction disconnecting said first and second contacts;
- a mechanical movement by said part of the guide member of a movable part of said switch, said interaction causing a movement of said movable part from a nominal position in which said first and second contacts are electrically isolated from one another, to a transitory position enabling said first and second contacts to touch, an interruption of said interaction resulting automatically in a return of said movable part to the nominal position thereof, said movement being for example a translational movement of said movable part or a rotation of said movable part about an axis of rotation.

Said part of the guide member is for example a sliding contact device of said guide member intended to bear against an upper face of said guide rail and that is capable of establishing an electrical connection between said first and second contacts by friction on an upper face of said contacts. For example, said sliding contact device includes a conductive surface intended to bear against the rail, for example against said upper face of said guide rail. Moreover, said part of the guide member may be at least one of the rims of the guide rollers or at least one of said rollers, each of said rims or rollers being for example able to cause a movement of said movable part of said switch or to induce a modification of a physical magnitude measurable by said sensor of said electrical switch, said physical magnitude being for example a value of an electric field or magnetic field or a radiation intensity or a wavelength.

Preferably, said first contact and said second contact are rigidly mounted on an isolating base attached to said load-bearing structure in order to form a contact strip, said contacts being arranged preferably longitudinally beside one another on a face of said isolating base, the other face of said isolating base being arranged to be attached to said load-bearing structure. In particular, said other face may be attached to an upper surface of the guide rail, for example to the railhead of said guide rail or to an upper extremity of a guide rail with no railhead, said surface or upper extremity of said guide rail preferably facing the chassis of the guided vehicle when this latter is above said guide rail.

In particular, each of said first and second contacts is an elongate plate of conductive material comprising at least one lateral side structured geometrically such that said lateral sides of said contacts, when they are arranged laterally in parallel with one another along the length thereof, fit together contactlessly. Specifically, said contacts each include a flat upper face arranged in the same plane, in particular when they are arranged on said isolating base. Preferably, said lateral side has a sinusoidal or crenellated (for example rectangular) geometric structure. Thus, according to the invention, the lateral side of one of said contacts has a geometric shape that is complimentary to the lateral side of another of said contacts such that these latter can be fitted together. Evidently, the person skilled in the art would be able to select other geometric arrangements for said contacts, which could simply be aligned in parallel beside one another or in a zigzag arrangement beside one another.

Preferably, said isolating base is an elongate plate of constant longitudinal trapezoidal section, the longitudinal section, as opposed to the cross-section, being the section taken perpendicular to one of the faces of the plate and along the length of the plate. In particular, the large base of said trapezoid is intended to bear against said load-bearing structure, for example against said rail along the length of said rail, and the small base of the trapezoid is designed to bear said first and second contacts, the adjacent angles of the large base being strictly less than 90°, such as to form an inclined plane leading to said contacts. Advantageously, the trapezoidal shape of said isolating base enables, if said part of the guide member is a sliding contact, a continuous movement of said sliding contact from an upper extremity or surface of the load-bearing structure (for example of said guide rail) to the upper face of said contacts without any steps between the level of the upper extremity or surface of said load-bearing structure and the level of said upper face of said contacts, said step potentially hindering said movement.

The present invention also concerns a system for checking the rail position of a vehicle guided by at least one guide rail, said guided vehicle having at least one guide member intended to force said guided vehicle to follow a path described by said guide rail, said guide member comprising for example a pair of rollers arranged in a V that are designed to clamp said guide rail and to bear thereagainst, potentially fitted with a conductive sliding contact, i.e. a device able to establish an electrical contact with said guide rail that is arranged to be in contact with said guide rail when said guided vehicle is correctly positioned on said guide rail, said monitoring system being powered electrically and comprising:

- a number m of electrical switches as described above, with m≥1, in particular m being at least two, each electrical switch being configured to interact mechanically or contactlessly with said part of a guide member of the guided vehicle;
- means for connecting each of said electrical switches, for example said contacts of said electrical switch, to a rail-position signaling system;
- said signaling system comprising an input terminal A and an output terminal B, a connection of each of said electrical switches between said input terminal A and said output terminal B. Specifically, each of said electrical switches is connected between the input terminal A and the output terminal B such that a value of a rail-position signal measurable at the output terminal B changes and switches from a nominal value to a transitory value only if each switch switches from said first to said second state, each of said switches being in particular initially in the same state in the absence of said interaction, i.e. either all open or all closed, and conversely said signaling system is configured such that said value of said rail-position signal measurable at the output terminal B then returns to said initial value once at least one of the switches returns to said first state, said rail-position signal being preferably intended to switch from A to B. Preferably, said signaling system includes either a serial connection of each electrical switch between the input terminal A and the output terminal B if each electrical switch is in an open state when in said first state, or a parallel connection of each electrical switch between the input terminal A and the output terminal B if each electrical switch is in a closed state when in said first state, said connection being configured such that each switch is in said first state in the absence of said interaction.

According to the present invention, the input terminal A is connected to the output terminal B by means of at least one electrical switch according to the invention. Advantageously, a rail-position signal intended to pass or to be propagated from the input terminal A to the output terminal B will have, at the output terminal B and according to the present invention, only two possible values at said output terminal B: said nominal value characterizing an absence of interaction with said part of a guide member for at least one of said switches, and said transitory value characterizing a simultaneous interaction of each electrical switch with said part of a guide member of said guided vehicle. Thus, the serial or parallel connection of the electrical switches provided to ensure they are all in the same state, i.e. said first state in the absence of said interaction with said part of a guide member, enables the simultaneous detection of the correct rail position for a plurality of guide members of said guided vehicle and also enables an incorrect rail position to be signaled if at least one of said guide members is incorrectly positioned on the rail.

More specifically, each electrical switch switches from said first state to said second state only in the event of interaction with said part of a guide member. Consequently, the nominal value of said rail-position signal measurable at the output terminal B only changes for said transitory value if each electrical switch connected in series or in parallel between the input terminal A and the output terminal B has switched from said first state to said second state. Indeed, a nominal value is measured at the output terminal B if at least one of said electrical switches remains in said first state. Thus, said signaling system according to the invention may in particular include an output terminal B characterized by a rail-position signal comprising a binary value, said "binary" rail-position signal having a transitory value and a nominal value, said binary rail-position signal only adopting the transitory value if each electrical switch is interacting with said part of a guide member, and adopting said nominal value if at least one of said electrical switches is not interacting with said part of one of the guide members of the guided vehicle, said transitory value being different from said nominal value.

In particular, and according to a first preferred embodiment, each electrical switch is connected in series to said terminals to form said serial connection, and is characterized by a first "open" state. In this case, as said first state corresponds to an open state of said electrical switch, each electrical switch is then open in the absence of said interaction, and said rail-position signal can only pass from the input terminal A to the output terminal B if each electrical switch is interacting with said part of one of the guide members of the guided vehicle, said interaction enabling the state of said electrical switch to be changed from "open" to "closed". According to this first preferred embodiment, if said rail-position signal has a value A0 at said input terminal A, a transitory value of A0 is only measurable at said output terminal B if each switch is interacting with said part of one of said guide members. In the opposite case, if at least one of said electrical switches is not interacting with said part, a nominal value that is different from the value A0 is measurable at said output terminal B. Thus, an electrical rail-position signal can pass from the input terminal A to the output terminal B only if the state of each of said switches is identical and is closed.

Similarly, according to a second preferred embodiment, each electrical switch is connected in parallel between the input terminal A and the output terminal B and is characterized by a first "closed" state. In this case, since in the absence of any interaction each electrical switch is closed, a rail-position signal with a value A0 at said input terminal A will then also have said value A0 as the nominal value at said output B, since said rail-position signal can pass freely between the input terminal A and the output terminal B in the absence of interaction of at least one of said electrical switches with said part of a guide member. Conversely, each electrical switch must be interacting with the part of one of the guide members of the guided vehicle for a transitory value BT that is different from said value A0 to be measurable at the output terminal B.

Specifically, the monitoring system according to the invention includes a device for retaining the value of said rail-position signal measurable at said output terminal B. Said retaining device is for example a memory or a bistable relay. In particular, said retaining device includes an input terminal ME and an output terminal MS, said input terminal ME being connected to said output terminal B, and said output terminal MS being connectable to a rail-position indicator. Preferably, said retaining device is able to supply, at the output terminal MS thereof, a retaining signal characterized by two values, a first value equal to the nominal value of said rail-position signal, and a second value equal to the transitory value of said rail-position signal. The retaining device is able to successively change the value of the retaining signal from the first value to the second value, then from the second value to the first value, and so forth, each time the rail-position signal changes from the nominal value thereof to the transitory value thereof, the rail-position signal changing from the transitory value thereof to the nominal value thereof therefore causing no change in said retaining signal. For example, said retaining device is able to:

a. change the value of the retaining signal supplied at the output terminal MS thereof such that this latter changes from said first value to said second value when said rail-position signal received at the input terminal ME thereof adopts a transitory value for the first time, then to retain said second value for said retaining signal supplied at the output terminal MS thereof when said rail-position signal returns to the nominal value thereof for the first time;

b. change the value of the retaining signal supplied at the output terminal MS thereof such that this latter changes from said second value to said first value when said rail-position signal received at the input terminal ME thereof changes from said nominal value to said transitory value for the second time, then to retain said first value for said retaining signal supplied at the output terminal MS thereof when said rail-position signal returns to the nominal value thereof for the second time;

c. repeat steps (a) and (b) above successively each time said rail-position signal changes from the nominal value thereof to the transitory value thereof.

Specifically, the retaining device according to the invention includes an electrical switch, as described above, configured to be arranged on said load-bearing structure, for example on said guide rail, downstream of said m electrical switches in consideration of the direction of movement of said guided vehicle on said guide rail. This electrical switch is hereinafter referred to as "supplementary electrical switch" to distinguish it from said m electrical switches described above. Specifically, the distance separating the supplementary electrical switch from the closest electrical switch of the m electrical switches is less than the distance separating said part of two successive guide members of said guided vehicle or of a single coach of said guided vehicle. Preferably, said supplementary electrical switch is connected to said input and output terminals A, B in parallel to said m electrical switches when these latter are connected in series according to said first embodiment. According to another preferred variant, said m electrical switches are connected in parallel between said input terminal A and a common node and said supplementary electrical switch is connected to said common node in series with said m electrical switches and to said output terminal B.

To avoid any ambiguity, by definition, "upstream" and "downstream" refer respectively to the direction a movement is coming from and the direction a movement is going to respectively with reference to the rail. A downstream position of an electrical switch in relation to an object means that the guided vehicle moving downstream will encounter, on the path thereof, first said object, then said electrical switch, and, conversely for said downstream position of an electrical switch in relation to another object.

Preferably, said monitoring system is characterized in that the number of electrical switches is equal to the number of guide members fitted to a coach of said guided vehicle. Specifically, said electrical switches are designed to be arranged on said load-bearing structure, for example on said guide rail, such that when one of said switches is interacting with said part of a guide member, then all the other switches are also interacting with said part of a guide member if this latter is correctly positioned on the rail. Specifically, the distances separating the electrical switches from one another are identical to the distances separating said parts of said guide members from one another, such that the arrangement of said electrical switches on said load-bearing structure along the guide rail mirror the arrangement of said parts of said guide members fitted to at least one coach of said guided vehicle. Thus, when a part of a guide member is in a position in which it is able to interact with one of said electrical switches, the part of at least one other guide member of the guided vehicle or of a coach of said guided vehicle is also in a position in which it is able to interact with one other electrical switch of said monitoring system according to the invention.

The present invention also relates to a guide rail for a vehicle guided by at least one guide member, said guide rail having a total of $m \geq 1$ electrical switches as described above. Specifically, the number m of electrical switches is the same as the number of guide members fitted to a coach of said guided vehicle, said switches being arranged on said guide rail, such that when one of said electrical switches is interacting with said part of a guide member, then all the other switches are also interacting with said part of a guide member if said guide member is positioned correctly on the rail. Preferably, said guide rail according to the invention includes, on an upper part intended to face the chassis of said guided vehicle, at least one low relief hollowed out of said guide rail, each low relief being designed to receive one of said m electrical switches such that each of said electrical switches can be fitted into said low relief, said electrical switch being arranged in the low relief such that the upper faces of said contacts are in the same plane, said plane also including the upper face of said upper part intended to face said chassis of the guided vehicle.

Finally, the present invention also concerns a method for automatically checking the correct rail position on a guide rail of one or more guide members of a guided vehicle with $k_i$ coaches having at least one guide member, i ranging from 0 to n−1, n being the number of coaches of said guided vehicle including at least one guide member, the method comprising:

a. A first movement of the coach $k_i$ of said guided vehicle to a first monitoring point, said first monitoring point being located downstream of at least one electrical switch of a system for monitoring the rail position of said guided vehicle, said electrical switch being arranged such that it is able to interact with said guide member, said movement being made up to said first monitoring point such as to match the position of each electrical switch with the position of a part of a guide member of the coach $k_i$ of the guided vehicle, said part being able to cooperate with said electrical switch such as to enable a change of state of said electrical switch;

b. A change of state of said electrical switch by interaction with said part of said guide member only if said guide member is correctly positioned on said guide rail;

c. A signal indicating the correct rail position of said guided vehicle only if each electrical switch has changed state;

d. A second movement of said coach $k_i$ of said guided vehicle downstream of said monitoring point only if said correct rail-position signal has been sent.

Preferably, said first monitoring point is arranged such as to simultaneously match, for all of the guide members of the coach $k_i$ of said guided vehicle, the position of said part of each guide member of said coach with the position on the guide rail of an electrical switch arranged to interact with said part of the guide member.

Preferably, said second movement of the coach $k_i$ is made from said first monitoring point to a second monitoring point, the distance separating said first monitoring point from said second monitoring point being equal to the length of one coach of said guided vehicle such that when coach $k_i$ is at the second monitoring point, coach $k_{i+1}$ is at the first monitoring point. Specifically, the method includes a repetition of stages (a) to (d) for each coach $k_i$ of said guided vehicle in order to check the rail position of all of the guide members of said guided vehicle.

BRIEF DESCRIPTION OF THE SEVERAL VIEWS OF THE DRAWING

To aid comprehension of the present invention, exemplary embodiments and applications are provided by the following.

DESCRIPTION OF THE INVENTION

Figure 1:
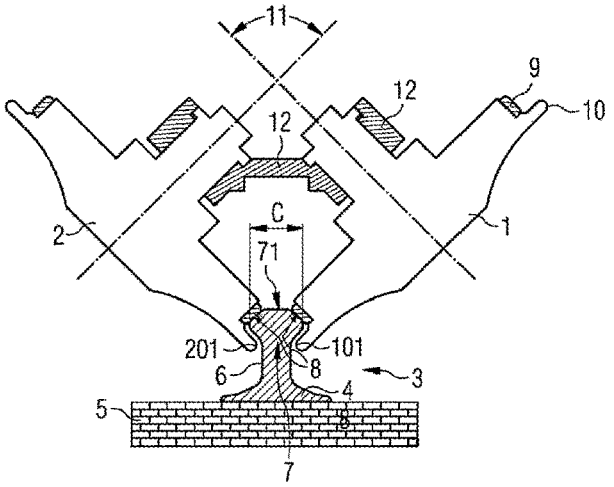
FIG. 1 Exemplary embodiment of a guide member correctly positioned on a guide rail.

The same reference characters are used in the different figures to represent identical or similar objects.

Figure 3:
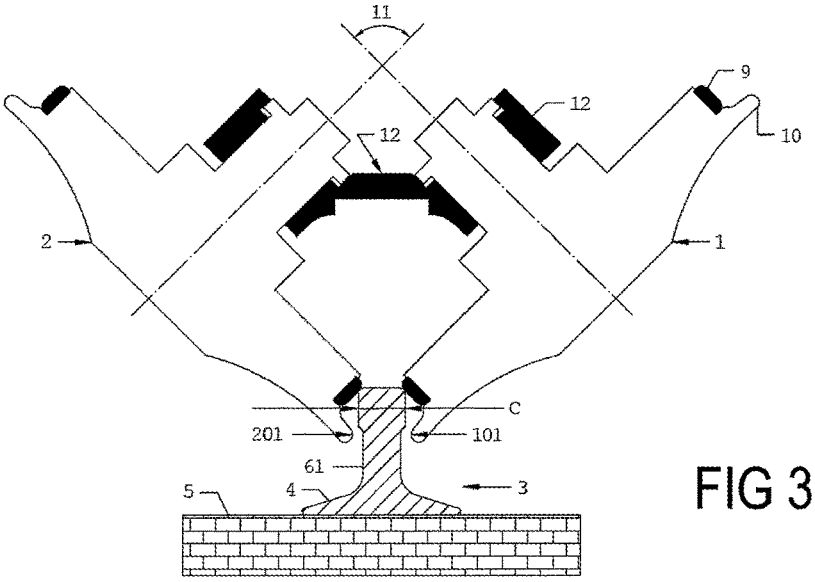
FIG. 3 Exemplary embodiment of a guide member correctly positioned on a guide rail with no railhead.

FIG. 1 shows a pair of rollers 1, 2 arranged in a V shape of a guide member known to the person skilled in the art. The pair of rollers 1, 2 clamps the guide rail 3 with which it is in contact and thus forces the guide member to follow a path defined by the rail 3, said path being consequently followed by the steering axle of the guided vehicle that is cooperating with said guide member. The present invention is intended to rapidly and reliably check that all of the rollers 1, 2 of the guide member of a guided vehicle are correctly positioned on the rail (see FIGS. 1 and 3), in particular when said guided vehicle passes through a check zone. This check zone is preferably in a location where a loss of guidance is most probable, such as at the exit of a siding or workshop (where the guide rail has no railhead), after a switch (change of guide rail), or following a guide rail fitted with an expansion joint (discontinuous rail).

A preferred exemplary embodiment of the monitoring system according to the invention is shown in FIGS. 4 to 8. The monitoring system includes an electrical switch 13 preferably installed on the guide rail 3 and a signaling system which may be installed on the ground. Specifically, said signaling system may also include a retaining device as described above and/or a rail position indicator installed on the ground (for example signal lights) or on the guided vehicle (for example luminous indicator).

Figure 4:
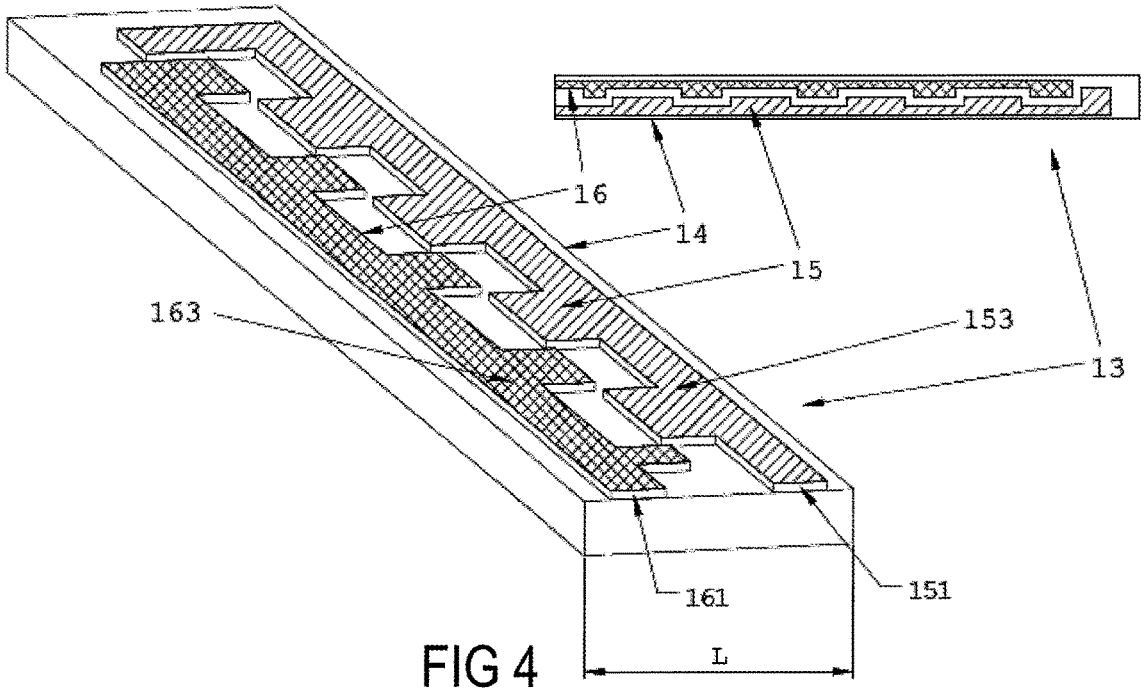
FIG. 4 Exemplary embodiment of an electrical switch according to the invention.
Figure 5:
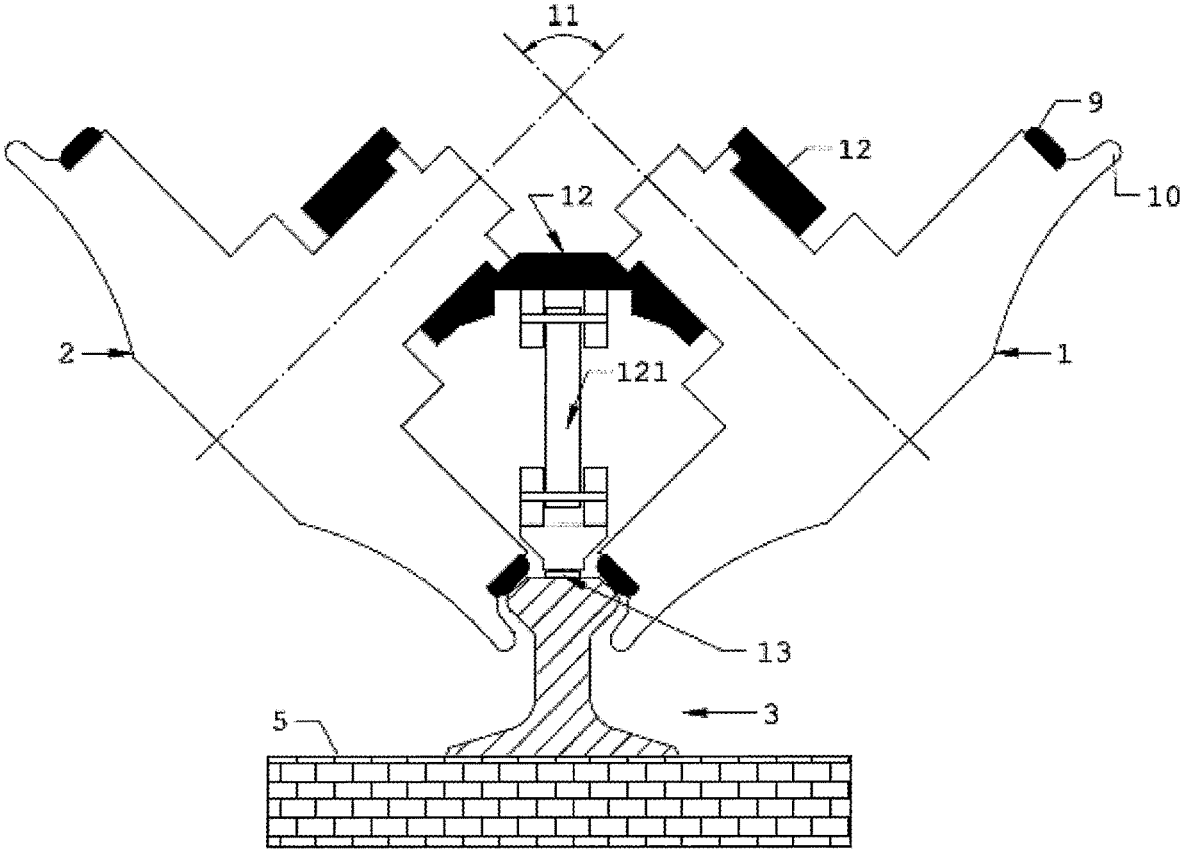
FIG. 5 Exemplary embodiment of a monitoring system according to the invention cooperating with a guide member.
Figure 6:
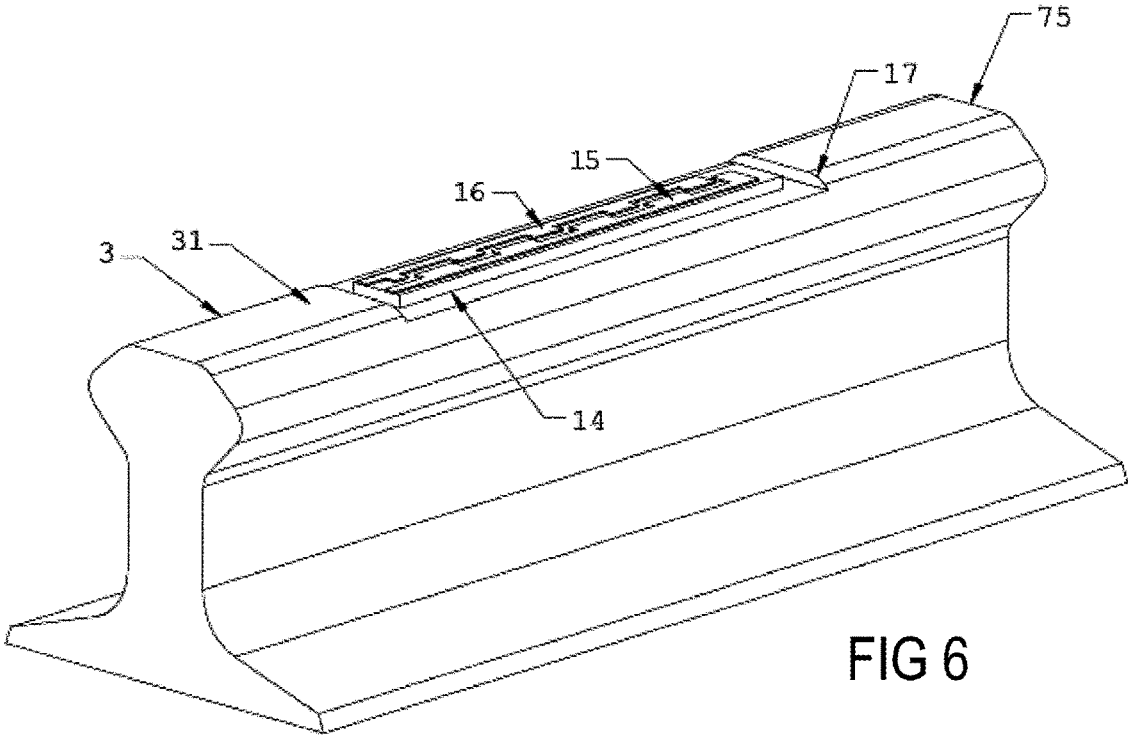
FIG. 6 Exemplary embodiment of a guide rail according to the invention.
Figure 7:
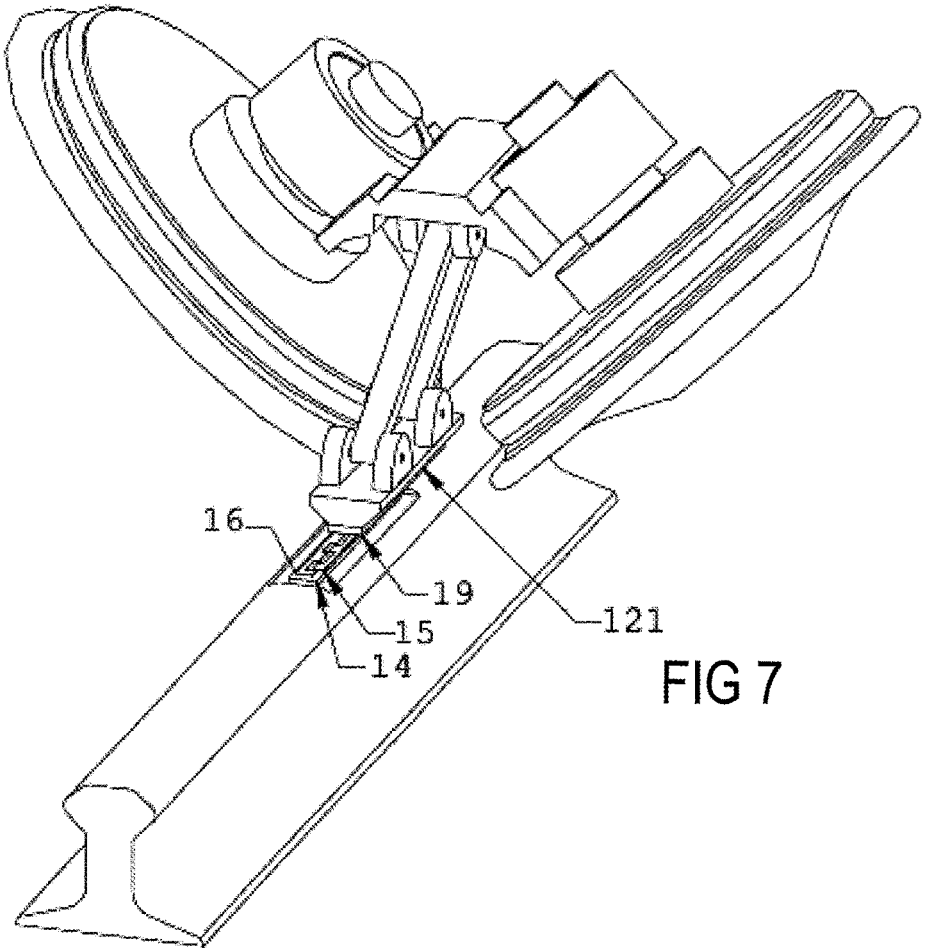
FIG. 7 Illustration of a cooperation of a guide member with the monitoring system according to the present invention.
Figure 8:
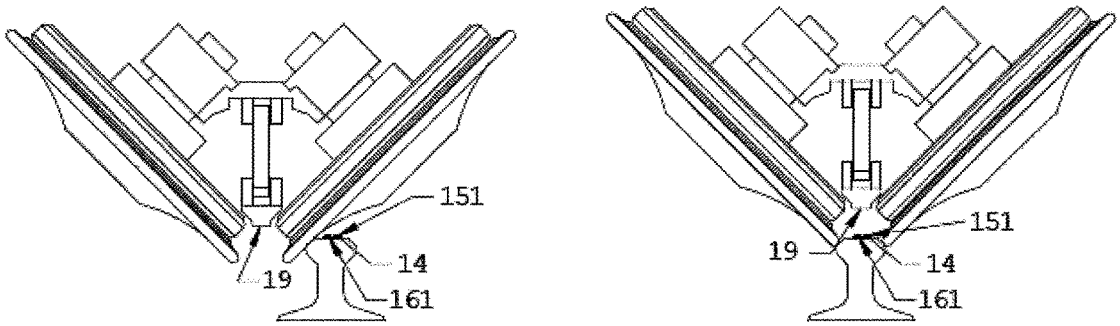
FIG. 8 Schematic illustration of the operation of a monitoring system according to the present invention.

A preferred embodiment of the electrical switch 13 according to the invention is shown in FIG. 4. Said electrical switch 13 includes an isolating base 14 and two contacts, respectively a first contact 15 and a second contact 16 assembled rigidly on said isolating base 14. The unit comprising said isolating base and said contacts forms a contact strip. Each of said contacts can be connected to said signaling system using connection means. For example, for each of said contacts, a conducting cable enables one extremity 151, 161 of said contact to be connected to said signaling system of the monitoring system according to the invention. The first contact 14 and the second contact 15 are in particular isolated from one another. However, if a conductive object simultaneously touches said contacts, for example the upper face 153, 163 of said contacts, the extremities 151, 161 and the cables connected to said extremities are then connected electrically, said switch then working as a closed contactor or switch.

Said electrical switch 13 is preferably installed on the guide rail, either directly attached to an upper face of said guide rail able to face the chassis of the guided vehicle (see FIG. 5), or attached in a recess formed in the mass of an upper part 75 of said guide rail (see FIG. 6), such that the upper faces of said contacts are at the same level as the upper surface 31 of said upper part 75 of said guide rail 3, the depth of said recess being equal to the thickness of said electrical switch. Advantageously, the recess or low relief 17 hollowed out of an upper part of said guide rail is arranged to match the level of the upper surface 31 of the guide rail 3 and the level of the upper faces 153, 163 of said contacts, such that a part 121 of a guide member intended to electrically contact said upper surface 31 of the rail 3 does not encounter any steps when moving from said upper surface 31 of the rail 3 to said upper faces 153, 163 of said contacts 15, 16. Preferably, if said electrical switch 13 is attached directly to the upper part 75 of the rail 3, the isolating base 14 can then have a trapezoid shape such as to include at each of the lengthways extremities thereof a ramp between the level of the upper face 31 of the rail 3 and the level of the upper faces 153, 163 of the electrical switch, thereby obviating the formation of a step between said faces and upper surfaces.

Figure 2:
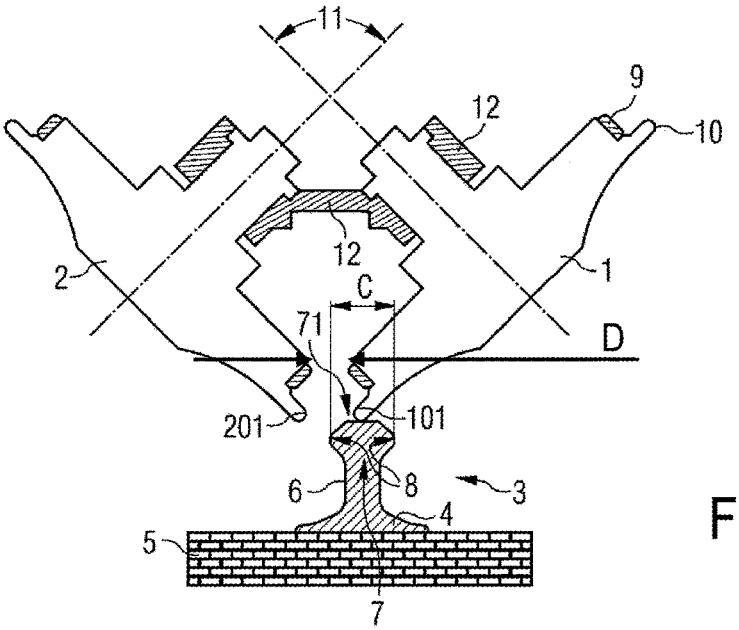
FIG. 2 Exemplary embodiment of a derailed guide member.

Preferably, the width L of said switch is less than the minimum distance D separating the tires 9 (see FIG. 2) of the rollers of the guide member. Furthermore, to ensure that the cables connected respectively to each of the extremities of said contacts are not disturbed/cut by the rollers of the guide member, said rail 3 in particular includes two holes formed in the body thereof to create a corridor inside the body of said guide rail, between a lower part of the web of said rail, for example below the position of the lower extremities 201, 101 of the two rims 10 surrounding the railhead 7 when correctly positioned on the rail, and the upper part where said electrical switch according to the invention is arranged.

The conductive object that closes said first and second contacts 15, 16 is a part of the guide member arranged to be in contact with or close to said guide rail when the guide member is correctly positioned on the rail. The present invention is therefore intended to create an interaction, in particular a mechanical interaction, between said electrical switch and an existing conductive part of the guide member. In other words, the present invention ingeniously uses a geometric arrangement of the guide member to "engage"/"disengage" said switch. Said existing part may be the lower extremities 201, 101 of the rims which could act on a push-button electrical switch, lever switch or contactless sensor, or said existing part can be a sliding contact 121 including a conductive surface 19 intended to make electrical contact with said rail 3. Thus, the passage of said conductive surface 19 of said sliding contact 121 over the upper faces 153, 163 of said contacts 15, 16 enable said contacts to be connected electrically to one another and an electrical current to be transmitted between the contacts 15, 16. Said sliding contact 121 includes in particular an attachment device to the guiding member that is able to maintain a contact between the conductive surface 19 thereof and said upper part of said guide rail 3 if the rail position is correct. Once the guide rollers have lost the correct rail position (see FIG. 8), the contact between said conductive surface 19 and said contacts 15, 16 is broken, said electrical switch then operating as an open contactor or switch.

Figure 11:
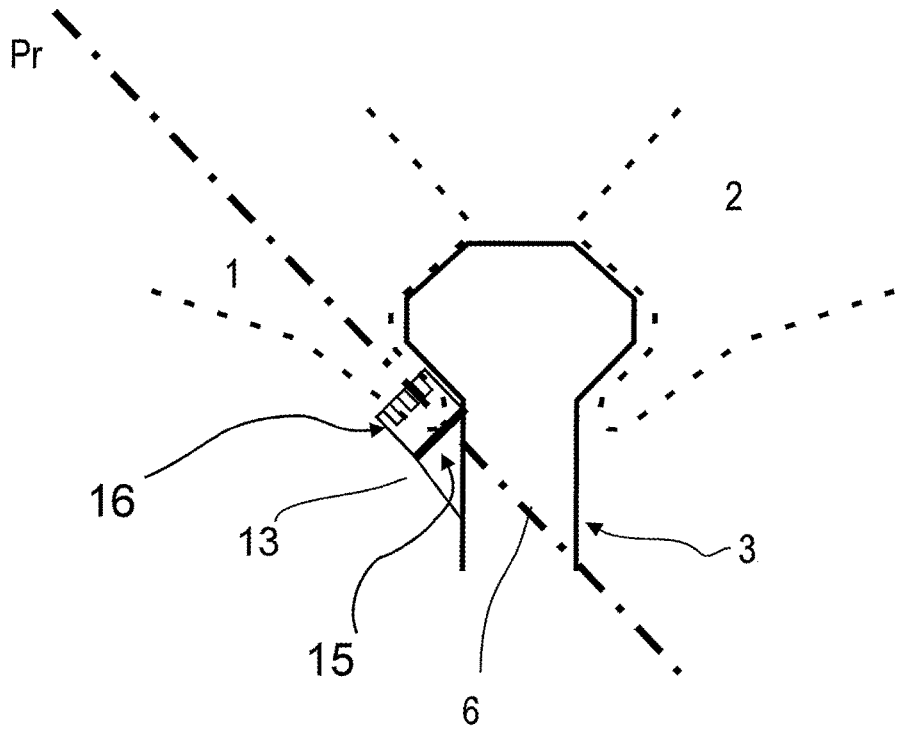
FIG. 11 Another exemplary embodiment of an electrical switch according to the invention.

FIG. 11 shows another preferred embodiment of an electrical switch 13 according to the invention. Unlike in FIGS. 4 to 8, at least one electrical switch 13 is attached, according to this other preferred embodiment, to the web 6 of said rail 3, beneath the railhead of said rail 3, at least on one side of the web 6 of said rail 3 such that it is in the running plane $P_r$ of at least one of the rollers 1, 2 of the guide member and can be actuated by pressure of the rim of said roller or guide wheel on a movable part of said electrical switch during a movement of the guide member along said rail. The switch is preferably a pushbutton that can be actuated mechanically by pressure of the rim or of the guide wheel on a movable contact 16 that is able to touch the fixed contact 15 when it is pressed by said rim.

Advantageously, the monitoring system according to the invention is able to simultaneously check the correct rail position of a plurality of guide members. Indeed, if for example each axle of a coach of a guided vehicle includes a pair of guide members placed respectively upstream and downstream of said axle (see FIGS. 9 and 10), then the present invention proposes, according to a preferred embodiment, placing a number of electrical switches equal to the number of guide members of said coach on said load-bearing structure, in particular on a guide rail 3. In particular, the distances separating the electrical switches from one another are equal to the distances separating said parts of the guide members from one another, such that when one of said electrical switches interacts with a part of one of the guide members, each of the other electrical switches of said guide rail also interacts with a part of another guide member. For example, when a first monitoring point 20 is reached by said guided vehicle, four electrical switches 13A, 13B, 13C, 13D each interact simultaneously with a part of a guide member of the coach of the guided vehicle, for example with a sliding contact of said guide member. Thus, the rail positions of the four guide members of the coach of the guided vehicle can be checked simultaneously.

Figure 9A:
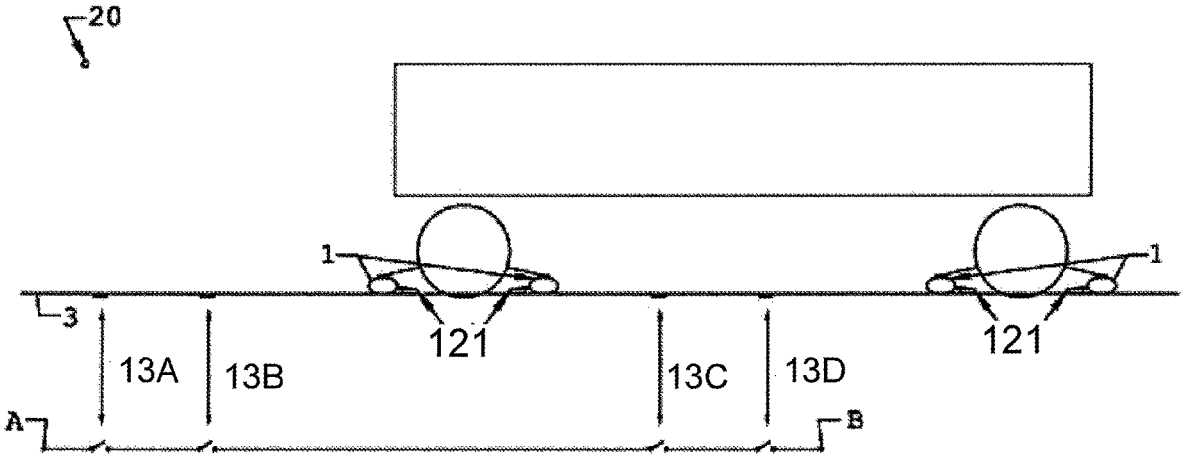
FIG. 9 Exemplary embodiment of a monitoring system according to the present invention.
Figure 9B:
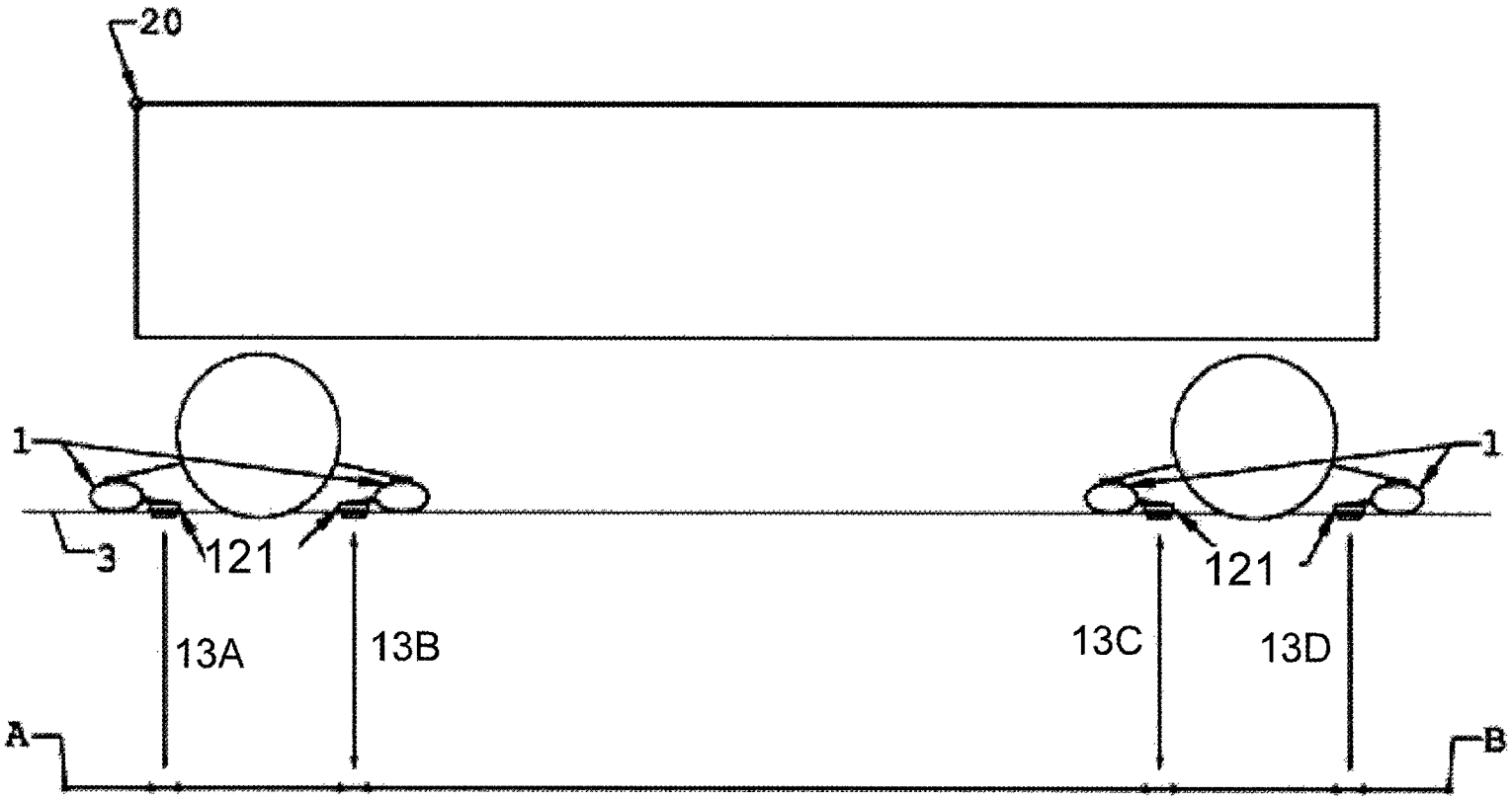

FIG. 9A in particular represents the guided vehicle, for example a train, before it reaches the monitoring point 20. The electrical switches 13A, 13B, 13C, 13D are in particular connected in series between an input terminal A and an output terminal B. In particular, if none of said electrical switches is interacting with said part 121 of a guide member, said electrical switch is in an open state. Thus, before said guided vehicle reaches the monitoring point 20, no current can flow between the input terminal A and the output terminal B. When the guided vehicle reaches the monitoring point 20 (see FIG. 9B), each electrical switch interacts with said part of the guide member if the rail position is correct, for example the first and the second contacts of the four electrical switches (13A, 13B, 13C and 13D) are simultaneously connected by interaction with said part 121 of the guide member, for example a conductive surface of a sliding contact. Consequently, the input terminal A and the output terminal B are linked electrically to one another only if the rail position of each of the guide members is correct. Indeed, if the rail position of one or more guide members is incorrect, the electrical connection between the input terminal A and the output terminal B is not made.

FIGS. 10A to 10F show another preferred embodiment of the invention, in which the monitoring system includes in particular two monitoring points, respectively a first monitoring point 20 and a second monitoring point 21, spaced at a distance equal to the length of one coach of a guided vehicle, and designed to monitor the rail position of a guided vehicle having a first and a second coach. The passage of each of the coaches beyond the first then the second monitoring point is checked by the monitoring system according to the invention, which is able to indicate, in particular by means of a first and a second rail-position indicator 22, 23, a permission to move the vehicle beyond said first then second monitoring point only if the rail positions of all of the rollers are correct. Said rail-position indicators are for example signaling lights and may preferably each be positioned respectively downstream of one of said monitoring points, as shown in FIGS. 10A to 10F. Each of said rail-position indicators 22, 23 is able to display a first signal 221, 231 and a second signal 222, 232, said first signal being able to indicate an incorrect rail position, and said second signal being able to indicate a correct rail position.

Figure 10A:
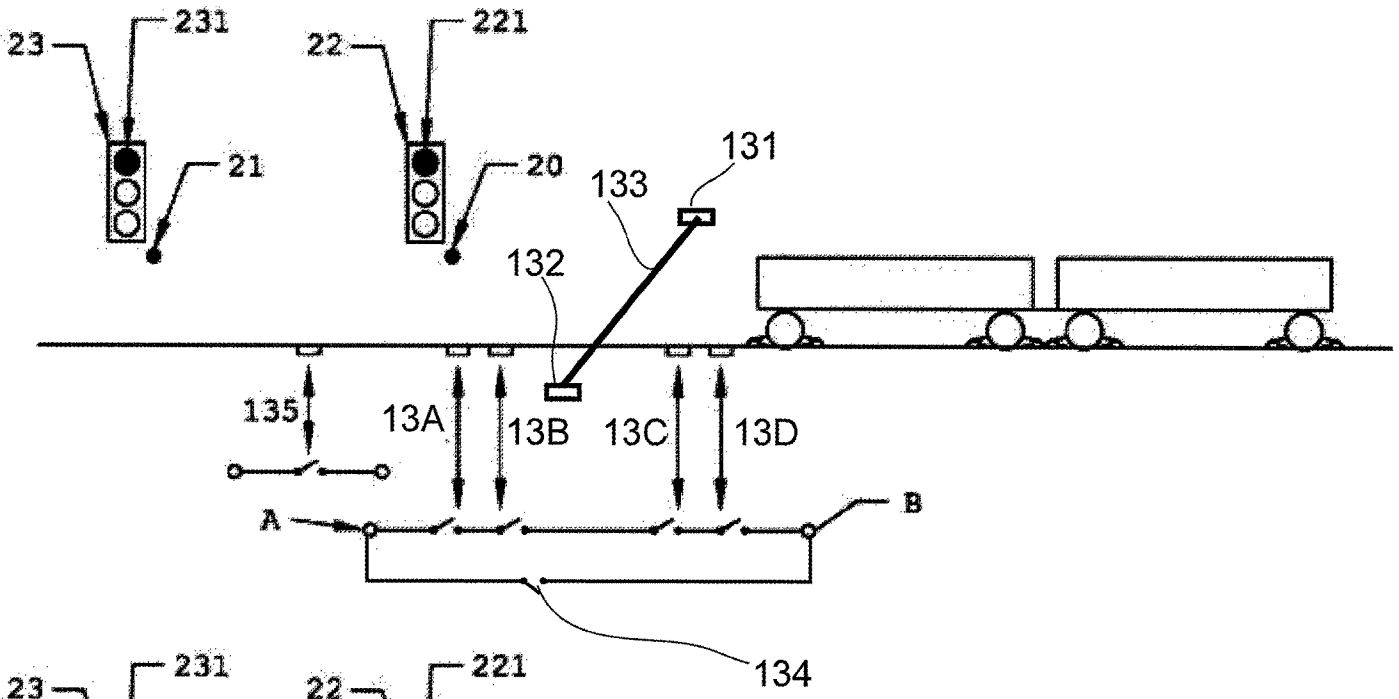
FIG. 10 Schematic representations of the operation of the monitoring system according to the invention.

As shown in FIG. 10A, if the guided vehicle moves towards the first monitoring point 21, the electrical switches 13A, 13B, 13C, 13D, arranged for example on the rail 3, do not simultaneously change from a first open state to a second closed state. Consequently, the input and output terminals A, B are not connected electrically and the rail-position indicators 22, 23, which in particular always indicate the same state as each other, indicate a derailed state of at least one guide member by means of said first signal, preventing said vehicle from passing the first monitoring point 20.

Figure 10B:
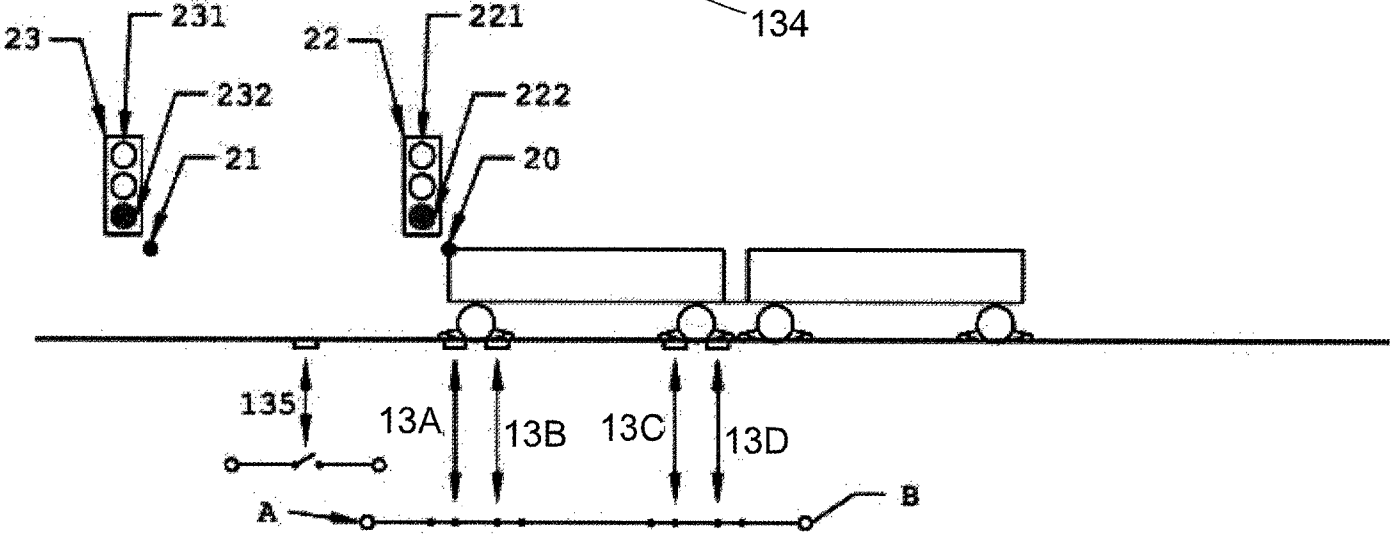

As shown in FIG. 10B, once the guided vehicle has reached the first monitoring point 20, each of the electrical switches 13A, 13B, 13C, 13D interacts simultaneously with said part of one of the guide members of the first coach of the guided vehicle and switches from said first state to said second state. Consequently, the input terminal A is connected to the output terminal B and a signal can travel from said input terminal A to said output terminal B, said signal being able to trigger a change in the rail-position indication provided by said rail-position indicators 22, 23, these latter indicating as a result a correct rail position of the guide members of the first coach by means of said second signal, thereby permitting the movement of said guided vehicle.

Said guided vehicle is then authorized by said monitoring system according to the invention to move forward to the second monitoring point 21, said second coach reaching the first monitoring point 20 as a result. Preferably, in order to prevent the rail-position indicators from indicating a derailed state when the guided vehicle moves towards the second monitoring point, a retaining device enables the correct rail-position indication to be maintained temporarily as said vehicle moves towards said second monitoring point 21. For this purpose, said retaining device includes for example a bistable relay and a supplementary electrical switch 135 used to temporarily store the correct rail position state of the guided vehicle, until said supplementary electrical switch 135 interacts with said part of a guide member.

Figure 10C:
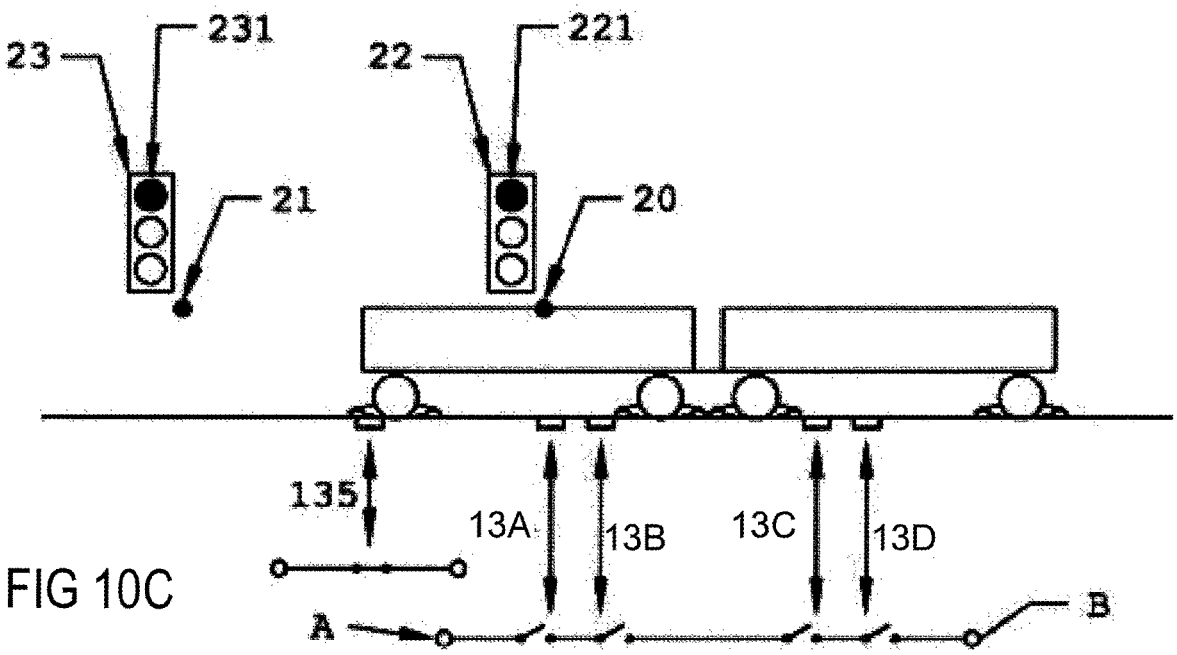
Figure 10D:
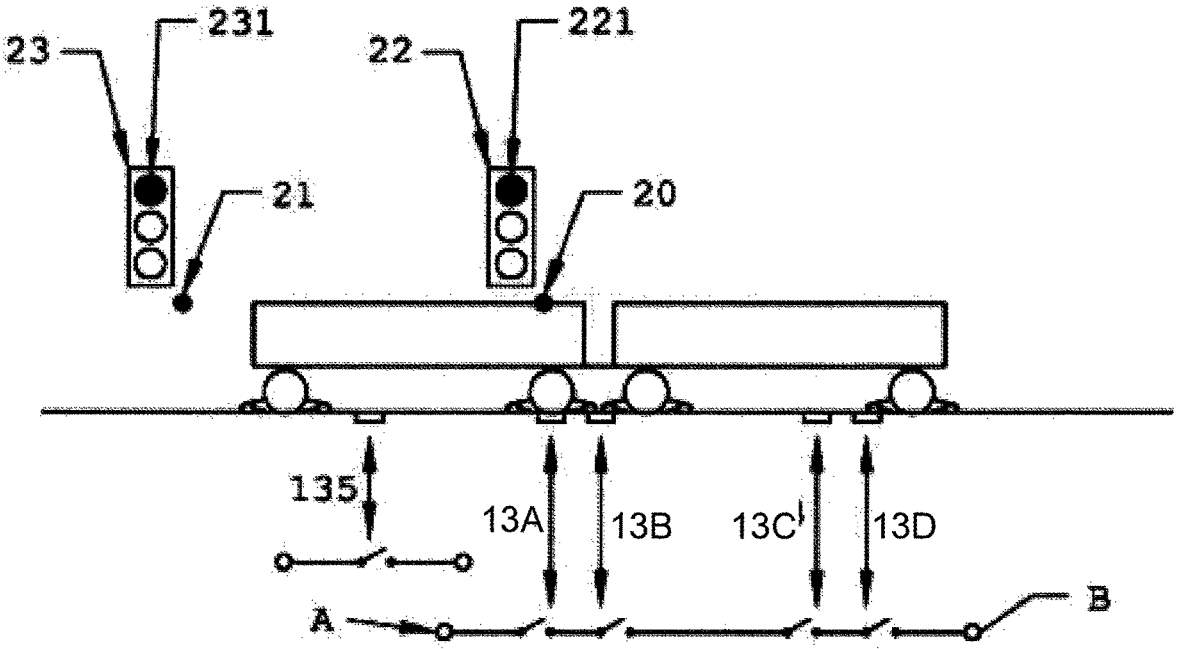

As shown in FIG. 10C, when said part of the guide member located furthest downstream in relation to the direction of movement of said guided vehicle begins to interact mechanically with said supplementary switch 135, said supplementary switch switches from said first state to said second state. This change of state involves changing the value of a measurable signal at the output terminal B that switches from a nominal value to a transitory value. Said transitory value is able to transmit information intended to change the status indication supplied by said rail position indicators, such that these latter indicate a derailed state of at least one guide member. For example, said transitory value is a reset signal of said bistable relay.

When said part of the guide member located furthest downstream in relation to the direction of movement of said guided vehicle passes the position of said supplementary switch 135, the rail-position indicators 22, 23 indicate a derailed state of at least one guide member. As the electrical switches 13A, 13B, 13C, 13D do not interact simultaneously with a part of the guide members of the second coach until said first coach has reached said second monitoring point 21, the rail-position indicators display the first signal.

Figure 10E:
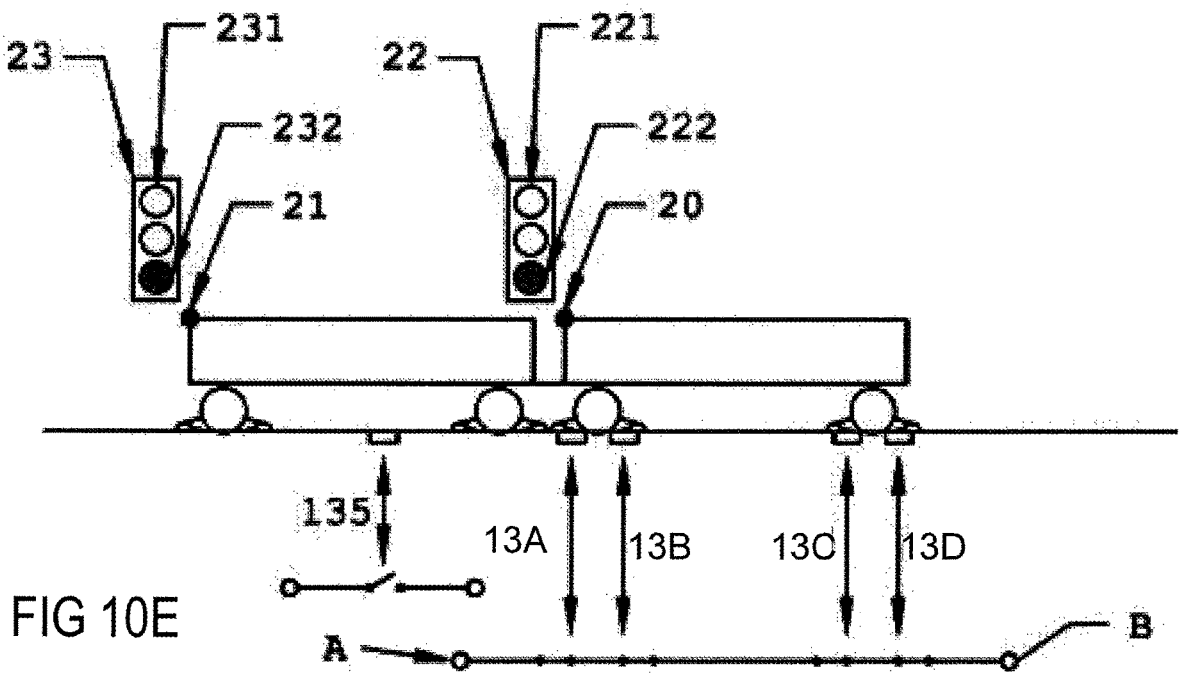
Figure 10F:
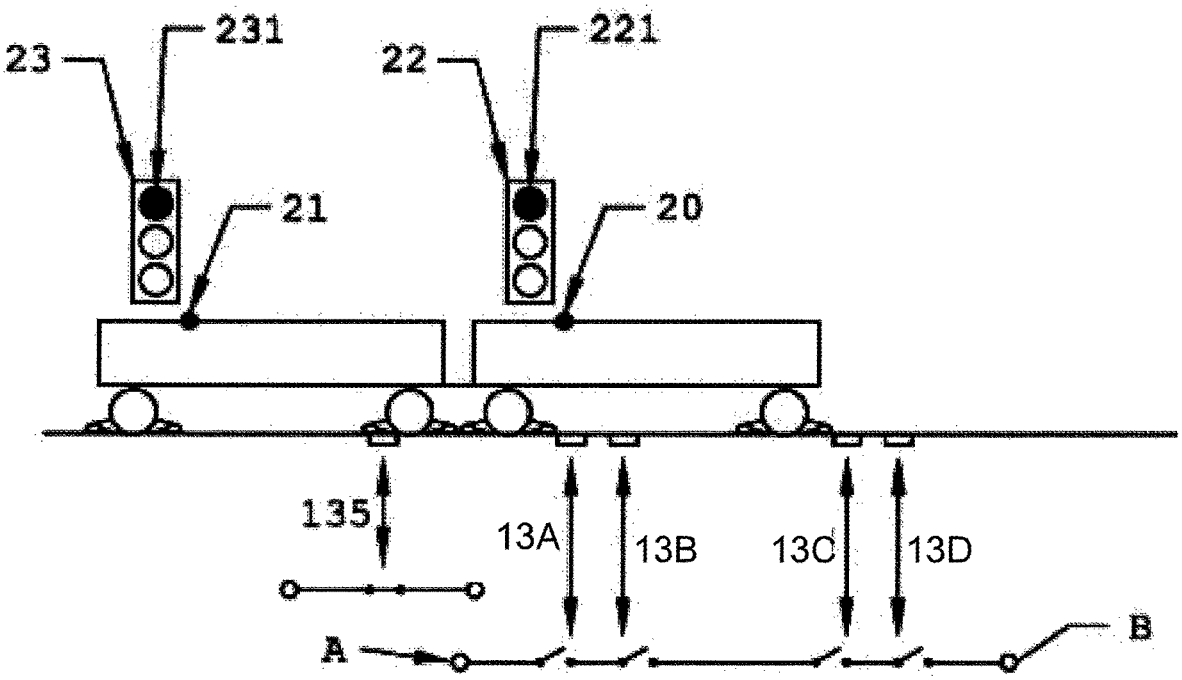

As shown in FIG. 10E, when the first coach of the guided vehicle reaches the second monitoring point 21 and the second coach reaches the first monitoring point 20, the electrical switches 13A, 13B, 13C, 13D switch from said first state to said second state, thereby connecting the input terminal A to the output terminal B and enabling a change of the signal displayed by said rail-position indicators 22, 23, which then indicate said second signal 222, 232, authorizing said guided vehicle to move beyond said second monitoring point 21.

Again, during movement of said guided vehicle downstream of said second monitoring point 21 (see FIG. 10F), said supplementary switch 135 interacts mechanically with a part of a guide member and switches from said first state to said second state. This change of state causes a change of the signal indicated by said rail-position indicators, which then display said first signal 221, 231 and prevent any movement of a subsequent guided vehicle beyond said first monitoring point 20.

The present invention thereby makes it possible to automatically check the correct rail position of all of the guide rollers of the guided vehicle and is able to monitor the movement of said guided vehicle by means of rail-position indicators installed on the ground, as shown in FIGS. 10A-10F, or on board said guided vehicle. The present invention proposes a simple method for monitoring the rail position of a guided vehicle, improving the reliability thereof compared to existing systems, which are susceptible to various faults, as well as reducing the cost of development, manufacture, installation and in particular maintenance, given that the present invention has no on-board systems intended to monitor rail position.

Preferably, said retaining device may also include a negative detector comprising an emitter 131 of a light beam 133, for example a laser source and a receiver 132 of said light beam 133, for example a CCD sensor, said light-beam emitter 131 being able to emit a light beam and said receiver 132 being able to receive said light beam and to generate a signal related to receipt of said light beam. In particular, said negative detector is able to actuate an auxiliary switch 134 using said signal related to the receipt of said light beam, said auxiliary switch 134 being characterized by two states, respectively a closed state and an open state. Said auxiliary switch is preferably mounted in parallel to said electrical switches between the input terminal A and the output terminal B (see FIG. 10A). The emitter 131 and the receiver 132 are in particular arranged on either side of said guide rail, either perpendicular to said guide rail or diagonally, preferably upstream of the electrical switch 13A closest to the first monitoring point that is intended to check the correct rail position of a guide member of a first axle (i.e. the one located furthest downstream) of a coach of the guided vehicle, and in particular downstream of the electrical switch 13C intended to check the rail position of the guide member of another axle of said coach of said guided vehicle. The auxiliary switch 134 and said negative detector are connected such that said auxiliary switch is in a closed state, i.e. it is electrically connecting the input and output terminals A, B, when the beam 133 emitted by the emitter 131 reaches said receiver 132, and open if the beam 133 emitted by the emitter 131 is not being received by the receiver 132. Consequently, unless the beam 133 of the negative detector is broken by a coach of the guided vehicle, the rail-position indicators 22, 23 are forced to display said second signal indicating a correct rail position, thereby authorizing movement of the guided vehicle. When said beam 133 is broken, the auxiliary switch 134 opens and said rail-position indicators 22, 23 then display said first signal, indicating an incorrect rail position. In this case, when the guided vehicle breaks said light beam, said auxiliary switch is kept in an open state by the negative detector and the rail-position indicators 22, 23 indicate a correct rail position only if each of the electrical switches 13A, 13B, 13C, 13D is interacting mechanically with said part of a guide member, as described above. Once the last coach of the guided vehicle has been checked by the monitoring system according to the invention, the rail-position indicators 22, 23 authorize it to move. Movement of the last coach towards the second monitoring point 22 releases said light beam, which will then be received by the receiver 132, which generates a signal requiring the auxiliary switch 134 to switch from the open state to the closed state, this latter forcing the rail-position indicators 22, 23 to indicate a correct rail position.

Figure 12:
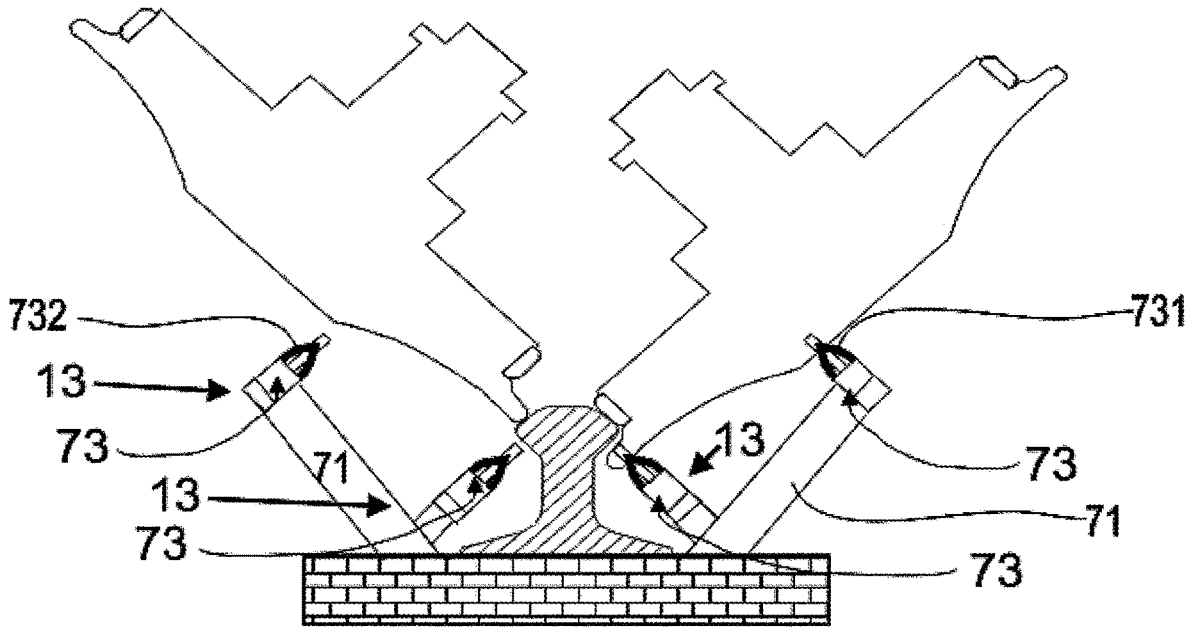
FIG. 12 Example positions of said electrical switch.

Finally, FIG. 12 shows different positions of said electrical switch 13 according to the invention in the vicinity of the guide member such as to enable the correct rail position thereof to be detected. According to the present invention, said electrical switches 13 can interact mechanically or contactlessly with at least one part of the guide member. Said electrical switch 13 includes for example a sensor 73 with a detection zone 731, 732 that is for example substantially conical and through which passes a part of said guide member only if the rail position of this latter is correct (for example, the sensor 73 is positioned such that a roller correctly positioned on the rail penetrates the detection zone 731 thereof), thereby enabling the presence of said guide member and the correct rail positioned thereof to be detected. Conversely, if the guide member is not correctly positioned on the rail, there is no interaction between the sensor and the guide member, since said guide member is no longer passing through the detection zone 732 of said sensor. Said electrical switch 13, in particular the sensor or contacts thereof, is borne by said load-bearing structure 71 which enables said electrical switch to be kept in a position enabling said interaction of said electrical switch 13 with said part of the guide member only if this latter is correctly positioned on the rail. The load-bearing structure 71 includes in particular one or more supporting elements, for example metal supporting elements, each of said supporting elements being attachable to the ground or to a supporting element of said rail, and enabling in particular the position of said switch to be adjusted in relation to said part of the guide member such as to enable said interaction.

In summary, the present invention provides several advantages over existing methods or devices in that:

- it has no on-board electronics or signal interpretation and transmission;
- it has no inductive sensors, thereby obviating the need for preventive maintenance work on the vehicle, which would have to be immobilized for such work to be carried out;
- the monitoring system is highly reliable, in that it is robust and not liable to break or suffer excessive wear;
- it simplifies maintenance operations;
- it reduces maintenance and installation costs as it does not require any on-board equipment;
- it requires no signal filtering, which could conceal a loss of guidance or a real problem.

The invention claimed is:

1. An electrical switch assembly for cooperating with a guide member of a vehicle guided by at least one guide rail, the electrical switch assembly comprising:

- an electrical switch configured to assume two states, respectively a first state and a second state, wherein said electrical switch is open in one of the two states and said electrical switch is closed in the other one of the two states;
- said electrical switch being mounted on a load-bearing structure, enabling said electrical switch to interact with the guide member when the guide member passes in a vicinity of said load-bearing structure;
- said electrical switch being configured to switch from the first state to the second state by an interaction with at least one part of said guide member and to return automatically to the first state once the interaction is interrupted or terminated;
- said switch including a first contact and a second contact mounted on a load-bearing structure said interaction being a mechanical interaction comprising a simultaneous and direct contact of said at least one part of said guide member with both of said first contact and said second contact; and
- said electrical switch being connected to a rail position signaling system for enabling a checking of a correct or incorrect position of the guide member on the guide rail in dependence on the state of said electrical switch.

2. The electrical switch assembly according to claim 1, wherein said first and second contacts are electrically insulated from the guide rail.

3. The electrical switch assembly according to claim 2, which comprises an isolating base formed with a lower face attached to an upper surface of the guide rail and an upper face, and wherein said first and second contacts are arranged longitudinally beside one another on said upper face of said isolating base.

4. The electrical switch assembly according to claim 1, wherein said load-bearing structure is the guide rail.

5. A monitoring system for monitoring a rail position of a vehicle guided by at least one guide rail, the vehicle having at least one guide member configured to require the guided vehicle to follow a path described by the guide rail and the monitoring system being powered electrically, the monitoring system comprising:

a number m of electrical switches according to claim 1, where m≥1, and each of said electrical switches being arranged to interact with a part of the guide member of the guided vehicle;

means for connecting each of the contacts of the electrical switch to a rail-position signaling system; and an input terminal A and an output terminal B, and a connection of each of said electrical switches between said input terminal A and said output terminal B.

6. The monitoring system according to claim 5, wherein the number m of electrical switches is equal to a number of guide members fitted to a coach of the guided vehicle.

7. The monitoring system according to claim 5, which comprises a retaining device for retaining a value of a rail-position signal that is measurable at said output terminal B.

8. The monitoring system according to claim 7, wherein said retaining device comprises a supplementary electrical switch being an electrical switch according to claim 1, said supplementary electrical switch being arranged downstream of said m electrical switches.

9. A guide rail for a vehicle guided by at least one guide member, the guide rail comprising a number m≥1 of electrical switches each according to claim 1.

10. The guide rail according to claim 9, wherein the number m of electrical switches is equal to a number of guide members fitted to a coach of the guided vehicle.

11. The guide rail according to claim 10, which comprises, on an upper part configured to face a chassis of the guided vehicle, at least one low relief hollowed out of said guide rail, said low relief being configured to receive one of said m electrical switches, said electrical switch being arranged in the low relief so that upper faces of said contacts are in a common plane, said plane also including the upper face of said upper part disposed to face the chassis of the guided vehicle.

12. A method for automatically checking a correct position on a guide rail of one or more guide members of a guided vehicle with coaches $k_i$, where i is an index ranging from 0 to n−1, and n is a number of coaches in the guided vehicle, the method comprising:

a) carrying out a first movement of a coach $k_i$ of the guided vehicle to a first monitoring point, the first monitoring point being located downstream of at least one electrical switch of a system for monitoring the rail position of the guided vehicle, the electrical switch being arranged to interact with a part of the guide member, the first movement being effected so as to match the position of each electrical switch with the position of at least one part of the guide member of the coach $k_i$ of the guided vehicle, the part being configured to cooperate with the electrical switch so as to enable a change of state of the electrical switch;

b) changing a state of the electrical switch by interaction with the part of the guide member only if the guide member is correctly positioned on the guide rail;

c) outputting a signal indicating a correct rail position of the guided vehicle only if each electrical switch has changed state; and d) carrying out a second movement of the coach $k_i$ of the guided vehicle downstream of the monitoring point only if the correct rail-position signal has been output.

13. The method according to claim 12, wherein the first monitoring point is arranged to simultaneously match, for all of the guide members of the coach $k_i$ of the guided vehicle, the position of the part of each guide member with the position on or near the guide rail of an electrical switch arranged to interact with the part of the guide member of the coach of the guided vehicle.

14. The method according to claim 13, wherein the second movement of the coach $k_i$ is a movement from the first monitoring point to a second monitoring point, wherein a distance separating the first monitoring point from the second monitoring point is equal to a length of one coach of the guided vehicle.

15. An electrical switch assembly for cooperating with a guide member of a vehicle guided by at least one guide rail, the electrical switch assembly comprising:

an electrical switch configured to assume two states, respectively a first state and a second state, wherein said electrical switch is open in one of the two states and said electrical switch is closed in the other one of the two states;

said electrical switch being mounted on a load-bearing structure, enabling said electrical switch to interact with the guide member when the guide member passes in a vicinity of said load-bearing structure;

said electrical switch being configured to switch from the first state to the second state by an interaction with at least one part of said guide member and to return automatically to the first state once the interaction is interrupted or terminated;

said electrical switch being connected to a rail position signaling system for enabling a checking of a correct or incorrect position of the guide member on the guide rail in dependence on the state of said electrical switch; and wherein said switch includes a first contact and a second contact mounted on a load-bearing structure so as to enable a mechanical interaction of at least one of said contacts with said guide member, and wherein said first and second contacts are electrically insulated from the guide rail.

* * * * *